United States Patent [19]

Bresson et al.

[11] Patent Number: 4,622,131

[45] Date of Patent: Nov. 11, 1986

[54] ORE FLOTATION

[75] Inventors: Clarence R. Bresson; H. Wayne Mark, both of Bartlesville, Okla.

[73] Assignee: Phillips Petroleum Company, Bartlesville, Okla.

[21] Appl. No.: 728,910

[22] Filed: Apr. 30, 1985

[51] Int. Cl.[4] ..... B03D 1/06; C22B 3/00

[52] U.S. Cl. ..... 209/167; 209/166; 252/61; 260/513.5; 558/248

[58] Field of Search ..... 252/61; 209/166, 167; 260/513.5, 455 B

[56] References Cited

U.S. PATENT DOCUMENTS

| | | | |
|---|---|---|---|
| 2,449,984 | 9/1948 | Gibbs | 209/167 |
| 3,551,499 | 12/1970 | Krockow | 260/455 B |
| 3,796,645 | 3/1974 | Fujita | 204/141.5 |
| 4,293,406 | 10/1981 | Werneke et al. | 209/166 |
| 4,482,480 | 11/1984 | Bresson et al. | 252/61 |
| 4,507,198 | 3/1985 | Unger et al. | 252/61 |
| 4,514,293 | 4/1985 | Bresson et al. | 252/61 |
| 4,533,466 | 8/1985 | Bresson et al. | 252/61 |
| 4,554,108 | 11/1985 | Kimble et al. | 260/455 A |

OTHER PUBLICATIONS

Chem. Abs., vol. 51:3096g, "Hair-Waving Preparations", Friedrich Epstein, 1952.

*Primary Examiner*—Robert A. Wax
*Attorney, Agent, or Firm*—John R. Casperson

[57] ABSTRACT

In an ore flotation process for recovering copper values from an aqueous slurry the improvement comprises a depressant composition of an amino-substituted carboxylic acid derivative or a mercapto-substituted carboxylic acid derivative in combination with a thiocarbonate derivative.

20 Claims, No Drawings

ORE FLOTATION

In one aspect the present invention relates to ore flotation and to a minerals depressant composition useful in an ore flotation process. In another aspect, the invention relates to an improvement in an ore flotation process wherein a blend of carboxylic acid derivatives is used as a minerals depressant.

Froth flotation is a process for recovering and concentrating minerals from ores. In a froth flotation process, the ore is crushed and wet ground to obtain a pulp. Additives such as mineral flotation or collecting agents, frothing agents, depressants, stabilizers, and the like are added to the pulp to assist in separating valuable minerals from the undesired gangue portions of the ore. The pulp is then aerated to produce a froth at the surface. The minerals which adhere to the bubbles or froth are skimmed or otherwise removed and the mineral-bearing froth is collected and further processed to obtain the desired minerals. Typical mineral flotation collectors include xanthates, amines, alkyl sulfates, arene sulfonates, dithiocarbamates, dithiophosphates, and thiols.

While the art of ore flotation has reached a significant degree of sophistication it is a continuing goal in the ore flotation industry to increase the productivity of ore flotation processes and above all to provide specific processes which are selective to one ore or to one metal over other ores or other metals, respectively, which are present in the material to be treated. One manner of providing more highly selective flotation processes is through the use of depressant compositions which reduce flotation of undesired metals or ores.

OBJECTS OF THE INVENTION

It is one object of this invention to provide a composition useful in ore flotation processes.

Another object of this invention is to provide a process to produce such a composition.

Yet a further object of this invention is to provide an improved flotation process using the new depressant composition.

A still further object is to improve the depression of certain minerals obtained when using blends comprising amino-substituted and/or mercapto-substituted carboxylic acid derivatives.

These and other objects, advantages, details, features and embodiments of this invention will become apparent to those skilled in the art from the following detailed description of the invention and the appended claims.

SUMMARY OF THE INVENTION

In one aspect of the present invention, there is provided a composition of matter comprising a blend of a first depressant which is a derivative of an amino-substituted and/or mercapto-substituted carboxylic acid derivative and a second depressant which is a thiocarbonate derivative.

In another aspect of the invention, the blend is used to depress certain minerals in an ore flotation process.

In another aspect of the invention, there is provided an improvement to a process for depressing mineral values from a froth produced from an aqueous slurry containing the ore with a derivative of an amino-substituted and/or mercapto-substituted carboxylic acid derivative. The improvement comprises employing a thiocarbonate derivative together with the amino-substituted and/or mercapto-substituted carboxylic acid derivative in the aqueous slurry.

In yet another aspect of the present invention, in a process for the recovery of copper values from an ore containing same, wherein the values are recovered in a froth from an aqueous slurry containing the ore or a concentrate from the ore, there is present a first depressant composition comprising an ammonium or Group IA metal salt of an amino-substituted and/or mercapto-substituted carboxylic acid derivative represented by the formula (I):

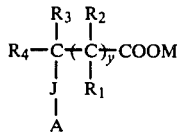

wherein M represents ammonium or Group IA metal; J represents S or NH; A represents H, M as previously defined, or

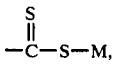

with the proviso that when J represents NH, A represents

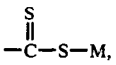

$R_1$ and $R_2$ are selected from the group consisting of hydrogen and an alkyl group having 1 to 3 carbon atoms; $R_3$ and $R_4$ are selected from the group consisting of hydrogen, alkyl group having 1 to 3 carbon atoms and COOM with M as previously defined; and y is zero to seven.

The inventive improvement comprises the use of formula (I) compounds in combination with a thiocarbonate derivative which can be prepared by the reaction of formula (II) compounds with formula (III) compounds as described by formulas (II) and (III):

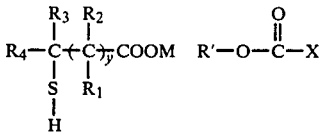

(II) (III)

wherein in formula (II) $R_1$, $R_2$, $R_3$, $R_4$, M, and y are the same as defined hereinabove in formula (I); and wherein in formula (III) R' is an alkyl group having 1 to 3 carbon atoms and X is selected from the group of Cl, Br and I.

The thiocarbonate derivatives referred to as the second depressant can be prepared by the reaction of formula (II) compounds with formula (III) compounds. First depressant formula (I) compounds are referred to generally hereinbelow as amino-substituted or mercapto-substituted carboxylic acid derivatives.

DETAILED DESCRIPTION OF THE INVENTION

In accordance with certain aspects of the present invention, there is provided a composition of matter which can be characterized as a blend of a first depressant composition and a second depressant composition. The first depressant composition preferably comprises a derivative of an amino-substituted carboxylic acid or a mercapto-substituted carboxylic acid. The second depressant composition is referred to herein as a thiocarbonate derivative. Preferably the first depressant composition and the second depressant composition each contain fewer than about 10 carbon atoms for good depressant action.

The first depressant composition preferably comprises an ammonium or Group IA metal salt of an amino-substituted or mercapto-substituted carboxylic acid derivative containing broadly 2 to 12 carbon atoms and preferably 2 to 7 carbon atoms and being described by formula (I):

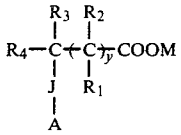

wherein M, J, A, $R_1$, $R_2$, $R_3$, $R_4$, and y are as defined hereinabove. Suitable Group IA metals for forming salts include the alkali metals such as lithium, sodium, potassium, rubidium and cesium.

The most preferred compounds described by formula (I) are the trithiocarbonates or the dithiocarbamates prepared, respectively, by the reaction of selected mercapto-substituted carboxylic acids or amino-substituted carboxylic acids with carbon disulfide under alkaline conditions. For example, a suitable mercaptodicarboxylic acid salt such as the trithiocarbonate derivative can be prepared by the reaction of carbon disulfide with 2-meraptosuccinic acid under alkaline conditions such as aqueous NaOH:

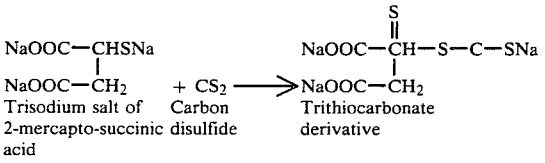

Another example of a preferred compound described by formula (I), can be prepared by the reaction of carbon disulfide with glycine(aminoacetic acid) under alkaline conditions such as aqueous NaOH:

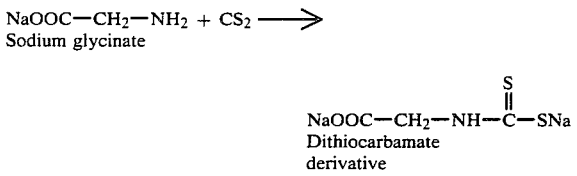

Suitable derivatives of amino-substituted carboxylic acids, and corresponding salts, and mercapto-substituted carboxylic acids, derivatives, and corresponding salts, encompassed by formula (I) include, 2-mercaptosuccinic acid, 2-mercaptoglutaric acid, 2-aminosuccinic acid, 3-mercaptoadipic acid, mercaptomalonic acid, disodium carboxymethyl trithiocarbonate, disodium caroxymethyl dithiocarbamate, and the like and mixtures thereof. Presently preferred first depressants include disodium 2-mercaptosuccinate, disodium carboxymethyl trithiocarbonate and disodium carboxymethyl dithiocarbamate.

The second depressant of the inventive blend comprises a thiocarbonate derivative which can be prepared by reacting compounds described by formula (II) with compounds described by formula (III):

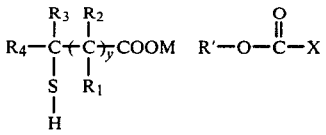

(II) (III)

wherein in formula (II) $R_1$, $R_2$, $R_3$, $R_4$, M, and y are defined as disclosed hereinabove and wherein in formula (III) R′, and X are defined as described hereinabove.

Suitable mercapto-substituted carboxylic acids described by formula (II) include 2-mercaptoglutaric acid, mercaptoacetic acid and the like as well as mixtures thereof including the corresponding Group IA metals and ammonium salts. Mercaptoacetic acids and particularly the corresponding sodium salt is highly preferred among the formula (II) compounds.

Suitable formula (III) compounds include ethyl chlorocarbonate, methylbromocarbonate, n-propylchlorocarbonate, isopropylbromocarbonate, methylchlorocarbonate, ethyliodocarbonate and the like and mixtures thereof. Ethylchlorocarbonate is highly preferred among the formula (III) compounds because of its availability and relatively low cost.

The second depressant compositions include alkyl carboxyhydrocarbyl thiocarbonate salts. Presently the most preferred representative second depressant includes O-ethyl-S-(sodium carboxymethyl)thiocarbonate. These materials can be prepared, respectively, under aqueous alkaline conditions such as aqueous NaOH by the reaction of mercaptoacetic acid with ethyl chlorocarbonate. For example:

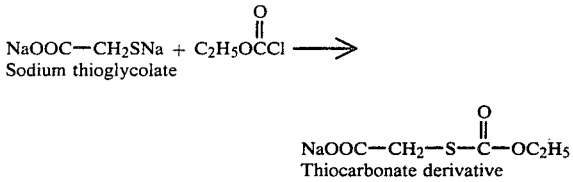

The first and second depressants are generally used in the form of aqueous alkaline solutions. For example, the preparation of a first depressant solution of a formula (I) compound is described Example II herein wherein 2-mercaptosuccinic acid is dissolved in aqueous NaOH. In Example III herein a representative second depressant is formed in aqueous alkaline solution by the reaction of ethyl chlorocarbonate with mercaptoacetic acid in aqueous NaOH. The preferred invention blend of representative and second depressants (tested in Example IV herein) was formed by combining suitable amounts of the aqueous alkaline solutions prepared in Examples II and III.

The resulting aqueous solution is the preferred form in which to use the second depressant composition. The preferred blend of the invention is preferably formed by combining the aqueous synthesis solutions containing the first depressant and the second depressant.

Generally, most any blend which contains the first depressant and the second depressant together will provide some benefit. However, blends which contain them together at a weight ratio which is in the range from about 10:90 to about 90:10 are preferred, more preferably in the range of 20:80 to 80:20. Most preferably the blend contains the thiocarbonate derivative and the amino-substituted or mercapto-substituted carboxylic acid derivative in amounts in the range of 50:50 to 80:20 by weight because amounts within this range have been shown to be effective. Since the first depressant and second depressant can be added to an ore flotation process alone or separately, it should be borne in mind that compositions embodying the invention may contain the blend at very dilute concentrations. Where the first depressant and the second depressant are preblended prior to adding them simultaneously to an ore flotation process, the inventive compositions will generally contain in the range of from about 0.1 to 50 parts by weight of blend calculated as weight of salt per 100 parts by weight of aqueous solution.

In another aspect of the present invention, the above described blend is employed as a minerals depressant for the recovery of copper values from an ore containing copper or a minerals concentrate from an ore containing copper. The invention has special applicability in a froth flotation process where the mineral values are recovered in a froth from an aqueous slurry containing the ore or a concentrate from the ore. Examples of suitable copper bearing ores which can be usefully processed in accordance with the invention are given in the following table.

TABLE

| | |
|---|---|
| Chalcocite, | $Cu_2S$ |
| Chalcopyrite, | $CuFeS_2$ |
| Covallite, | $CuS$ |
| Bornite, | $Cu_5FeS_4$ |
| Cubanite, | $Cu_2SFe_4S_5$ |
| Valerite, | $Cu_2Fe_4S_7$ or $Cu_3Fe_4S_7$ |
| Enargite, | $Cu_3(As,Sb)S_4$ |
| Tetrahedrite, | $Cu_3SbS_2$ |
| Tennanite, | $Cu_{12}As_4S_{13}$ |

Generally, the slurry will contain from about 5 to about 75 weight percent solids or more of one or more of the above described copper ores or concentrate from them, usually in the range of about 10 to about 50 weight percent. The slurry will generally also contain mineral flotation or collecting agents, frothing agents, depressants, stabilizers, and the like. For example, frothing agents which may be used in conjunction with the present invention in the slurry include polypropylene and polyethylene glycols and the corresponding methyl or ethyl ethers. In addition, isophorone and/or methyl isobutyl carbinol could also be used. The slurry will also contain both of the above described minerals depressants when the present invention is used. The combined amount of minerals depressant blend used, sans water, will usually be in the range from about 0.01 to about 20 pounds of minerals depressant per ton of ore, usually in the range of from about 0.1 to about 10 pounds of minerals depressant per ton of ore and preferably in the range of 0.15 to about 6 lb/ton solids. For ore concentrates, higher concentrations of mineral collector can be used if desired. Usually, the first depressant and the second depressant will be present in the slurry together at a weight ratio in the range of from about 20:80 to about 80:20, most preferably at a weight ratio in the range of about 50:50 to about 20:80 which has provided good results in tests.

In another aspect of the present invention, a froth flotation process employing amino-substituted or mercapto-substituted carboxylic acid derivative in combination with a selected thiocarbonate derivative can exhibit more selective depressant activity than either component alone. In accordance with the most preferred embodiment of the invention, the thiocarbonate derivative is employed in sufficient amount with amino-substituted and/or mercapto-substituted carboxylic acid derivatives to result in higher copper values in the froth than would be the case where the amino-substituted and/or mercapto-substituted carboxylic acid derivatives were used alone. Generally speaking, the process employing the amino-substituted and/or mercapto-substituted carboxylic acid derivatives can be improved by utilizing the thiocarbonate derivative in an amount in the range of from about 0.05 to about 4 parts by weight for each part by weight of amino-substituted and/or mercapto-substituted carboxylic acid derivatives. More preferably, the thiocarbonate derivative is employed in an amount in the range of from about 0.1 to about 2 parts by weight per part by weight of the amino-substituted and/or mercapto-substituted carboxylic acid derivatives. Most preferably from 0.5 parts to about 2 parts of thiocarbonate derivative is used together with each part of amino-substituted and/or mercapto-substituted carboxylic acid derivatives. In this embodiment, the combined concentration of the first depressant and the second depressant is usually sufficient to impart to the slurry in the range of from about 0.1 to about 10 pounds of combined depressant blend, sans water, per ton of ore, where the weight ratio of amino-substituted and/or mercapto-substituted carboxylic acid derivatives and carbamate or thiocarbonate derivative is about 1:2.

Any froth flotation apparatus can be used in this invention. The most commonly used commercial flotation machines are the Agitar (Galigher Co.), Denver D-2 (Denver Equipment Co.); and the Fagergren (Western Machinery Co.). The invention is illustrated by the following examples.

EXAMPLE I

Control Run With No Depressant

This example describes a mineral ore flotation process test wherein no mineral depressant was used.

A charge of 750 g of a Cu/Ni/Fe containing ore (Falconbridge), 300 mL of tap water and 0.65 g lime (1.73 lb/ton) was placed in a ball mill and the mixture was ground for 2 minutes and 55 seconds. The ground slurry was transferred to a 2.5 liter capacity Denver D-12 flotation cell along with enough water to make about a 30 weight percent slurry. To this slurry there was added 3 drops (0.034 lb/ton) of a commercial frother (Dowfroth 250) and 6 mL (0.16 lb/ton) of a 1 weight percent aqueous solution of sodium isopropyl xanthate (A-11 from American Hoechst). After conditioning this slurry at 1100 rpm for one minute, the slurry was floated for 7 minutes and the concentrate filtered, dried and analyzed. The procedure was repeated and an average weight percent recovery was calculated from the two runs. The average weight percent recoveries in this example were: Cu 79.9%; Ni 51.3% and Fe 22.2%. Thus, in these tests wherein no depressants were used, the ratio of the average weight percent recoveries for copper and iron was 3.6 (79.9÷22.2).

EXAMPLE II

Preparation of Disodium 2-Mercaptosuccinate as a Representative first Depressant This example describes the preparation of a 20 weight percent aqueous solution of a representative first depressant, viz., disodium 2-mercaptosuccinate, which was used in preparing the inventive depressant blend disclosed in Example IV.

An approximately 20 weight percent aqueous solution of disodium 2-mercaptosuccinate was prepared by dissolving 2 g (0.05 mole) of sodium hydroxide in 14 g of water and then adding 3.5 g of 87 weight percent purity 2-mercaptosuccinic acid (0.02 mole of active ingredient). This stock solution was easily prepared in any appropriate quantity as needed and used without further purification or separation.

EXAMPLE III

Preparation Of O-Ethyl-S-(Sodium Carboxymethyl)Thiocarbonate as a Representative Second Depressant This example describes the preparation of a 30 weight percent aqueous solution of O-ethyl-S-(sodium carboxymethyl)thiocarbonate, a representative second depressant.

A charge of 84 g (2.1 moles) sodium hydroxide and 170 mL of water was placed in a 1-liter round bottomed flask equipped with a stirrer, dropping funnel and thermometer. The reaction vessel was positioned in an ice-water bath and the temperature of the reaction mass was maintained below about 20° C. throughout the slow-addition of 115.2 g of 80 weight percent purity mercaptoacetic acid (1 mole of active ingredient). After all of the acid had been added, the resulting mixture of disodium mercaptoacetate was stirred for a few minutes before the gradual addition of 92.5 g (0.85 mole) ethylchlorocarbonate. After all of the ethylchlorocarbonate had been added, a significant amount of a white solid had precipitated. A 60 mL sample of water was added to the reaction mixture to give an approximately 30 weight percent aqueous solution of a representative second depressant, viz., O-ethyl-S-(sodium carboxymethyl)thiocarbonate.

EXAMPLE IV

Inventive Blend of Representative First and Second Depressants in an Ore Flotation Test This example describes a mineral ore flotation process test similar to that described in Example I except for the addition of a 1:1 volume:volume blend of the reaction masses of representative first and second depressants prepared in Examples II and III.

A 1:1 volume:volume blend of the 20 weight percent aqueous solution of disodium mercaptosuccinate (prepared in Example II) and the 30 weight percent aqueous solution of O-ethyl-S-(sodium carboxymethyl)thiocarbonate (prepared in Example III) was used as the inventive depressant in a flotation test procedure carried out as described in Example I. Sufficient amounts of the reaction masses from Examples II and III were used to give, respectively, 1.8 lb/ton and 3.2 lb/ton normalized levels of first and sescond depressants based on pounds of said reaction masses per ton oi total test mixture. The average weight percent recoveries of duplicate test runs were: Cu 69.3%; Ni 32.8% and Fe 11.9%. Thus, in these tests with the inventive blend of representative first and second depressants, the ratio of the average weight percent recoveries for copper and iron was 5.8 (69.3÷11.9).

EXAMPLE V

Disodium 2-Mercaptosuccinate as a Representative first Depressant in an Ore Flotation Test This example describes a mineral ore flotation process test similar to that described in Example I except for the addition of a sample of the reaction mass from Example II as a representative first depressant.

Sufficient sample of the reaction mass prepared in Example II was used to give a 2 lb/ton level of said reaction mass solution per ton of total test mixture. The average weight percent recoveries from duplicate runs were: Cu 43.5%, Ni 22.8% and Fe 7.9%. Thus, in these tests the use of a representative first depressant, viz., the disodium mercaptosuccinate solution alone, resulted in a ratio of 5.5 calculated from the weight percentage recoveries for Cu and Fe (43.6÷7.9).

EXAMPLE VI

O-Ethyl-S-(Sodium Carboxymethyl)Thiocarbonate as a Representative Second Depressant in an Ore Flotation Test This example describes a mineral ore flotation process test similar to that described in Example I except for the addition of a sample of the reaction mass from Example III as a representative second depressant.

Sufficient sample of the reaction mass prepared in Example III was used to give a 5 lb/ton level of said reaction mass solution per ton of total test mixture. The average weight percent recoveries based on duplicate runs were: Cu 75.3%; Ni 45% and Fe 23.1%. Thus, in these runs using only the representative second depressant reaction mass prepared in Example III, the ratio of the average weight percent recoveries for copper and iron was 3.3 (75.3÷23.1).

The results of the ore flotation tests are summarized in Table I.

TABLE I

| Ore Flotation Tests[d] | | | | | | | | | |
|---|---|---|---|---|---|---|---|---|---|
| | | | Reagents, lb/ton | | | Wt % Recovery | | | % Cu / % Fe |
| Run No. | Example No. | Type of Run | NaIPX[a] | $Na_2MS$[b] | ESCMTC[c] | % Cu | % Ni | % Fe | |
| 1 | I | Control | 0.16 | None | None | 79.9 | 51.3 | 22.2 | 3.6 |
| 2 | V | Control | 0.16 | 2.0 | None | 43.6 | 22.8 | 7.9 | 5.5 |
| 3 | VI | Control | 0.16 | None | 5.0 | 75.3 | 45.0 | 23.1 | 3.3 |

TABLE I-continued

| | | | Ore Flotation Tests[d] | | | | | | |
|---|---|---|---|---|---|---|---|---|---|
| | | | Reagents, lb/ton | | | Wt % Recovery | | | % Cu / % Fe |
| Run No. | Example No. | Type of Run | NaIPX[a] | $Na_2MS$[b] | ESCMTC[c] | % Cu | % Ni | % Fe | |
| 4 | IV | Inventive | 0.16 | 1.8 | 3.2 | 69.3 | 32.8 | 11.9 | 5.8 |

[a]NaIPX represents "1 weight percent aqueous sodium isopropyl xanthate" solution
[b]$Na_2MS$ represents "20 weight percent aqueous disodium mercaptosuccinate" solution
[c]ESCMTC represents "30 weight percent aqueous O—ethyl-S—(sodium carboxymethyl)thiocarbonate" solution
[d]Tests were carried out at a pH of 9.

Referring to the invention run 4 in Table I, it is evident that the inventive blend of disodium mercaptosuccinate (as a 20 weight percent aqueous solution) and O-ethyl-S-(sodium carboxymethyl)thiocarbonate (as a 30 weight percent aqueous solution) provided the most effective system for depressing iron recovery relative to copper recovery: the ratio of % Cu to % Fe being 5.8 which is higher than the ratios shown for the control runs 1, 2 and 3. Thus, the blend of sodium 2-mercaptosuccinate (a representative first depressant) and O-ethyl-S-(sodium carboxymethyl)-thiocarbonate (a representative second depressant) was more selective than was either the first or second depressant alone in regard to depressing iron recovery relative to copper recovery.

What is claimed is:

1. A composition of matter comprising a blend of a first depressant and a second depressant, wherein the first depressant is represented by the formula

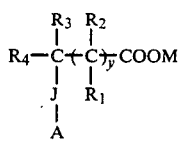

where M represents ammonium or Group IA metal; J represents S or NH; $R_1$ and $R_2$ are selected from the group consisting of hydrogen and alkyl group having 1–3 carbon atoms; $R_3$ and $R_4$ are selected from the group consisting of hydrogen, alkyl group having 1–3 carbon atoms, and —COOM where M is as previously defined; A represents

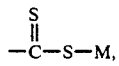

where M is as previously defined, or H or M provided that J represents S, and y is in the range of 0–7 and the second depressant comprises a thiocarbonate derivative.

2. A composition of matter as in claim 1 wherein the second depressant is prepared by the reaction of a material represented by the formula

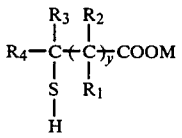

with a material represented by the formula

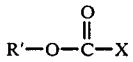

where M, y, $R_1$, $R_2$, $R_3$, and $R_4$ are as defined about, R' is an alkyl group having 1–3 carbon atoms and X is selected from the group consisting of Cl, Br and I.

3. A composition as in claim 2 comprising an aqueous solution of said first depressant and said second depressant.

4. A composition as in claim 3 comprising the first depressant and the second depressant at a weight ratio which is in the range of from about 10:90 to about 90:10.

5. A composition as in claim 3 comprising the first depressant and the second depressant at a weight ratio which is in the range of from about 20:80 to about 80:20.

6. A composition as in claim 3 comprising the first depressant and the second depressant at a weight ratio which is in the range of from about 50:50 to about 80:20.

7. A composition as in claim 5 comprising in the range of from about 0.1 to about 50 parts by weight of the blend per 100 parts by weight of water.

8. A composition as in claim 5 further comprising a solids slurry of copper-containing ore or a concentrate thereof, the blend being present in an amount in the range of from about 0.01 to about 20 pounds of blend per ton of solids.

9. In a process for the recovery of copper values from an ore or concentrate containing same, wherein the values are recovered in a froth from an aqueous slurry containing the ore or concentrate, wherein a first depressant composition represented by the formula

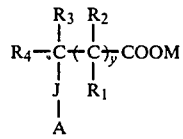

where M represents ammonium or Group IA metal; J represents S or NH; A represents

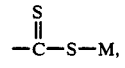

where M is as previously defined, or, provided that J=S, H or M as previously defined; $R_1$ and $R_2$ are selected from the group consisting of hydrogen and alkyl groups having 1–3 carbon atoms; $R_3$ and $R_4$ are selected from the group consisting of hydrogen, alkyl group having 1–3 carbon atoms, and COOM where M is as previously defined, and y is 0–7 is employed as a minerals depressant in the aqueous slurry to reduce the amount of certain depressed minerals in the froth, the improvement comprising employing a second depressant composition comprising a derivative of a thiocarbonate together with the first depressant composition in an amount sufficient to increase the copper values in the froth.

10. A process as in claim 9 wherein the first depressant composition comprises a mercaptodicarboxylic acid salt and wherein the second depressant composition comprises an alkyl carboxyhydrocarbyl thiocarbonate salt.

11. A process as in claim 9 wherein the second depressant composition is prepared by the reaction between a material represented by the formula

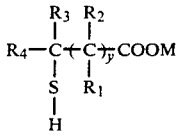

with a material represented by the formula

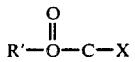

where M, y, $R_1$, $R_2$, $R_3$ and $R_4$ are as previously defined R′ is an alkyl group having 1–3 carbon atoms and X is selected from the group consisting of Cl, Br, and I.

12. A process as in claim 11 wherein sufficient of the second depressant composition is added so as to impart to the slurry a weight ratio of first depressant composition to second depressant composition in the range of from about 10:90 to about 90:10.

13. A process as in claim 11 wherein the second depressant composition comprises an alkylcarboxyalkylthiocarbonate salt and the first depressant composition is a derivative of a mercaptopolycarboxylic acid or a derivative of an aminopolycarboxylic acid and sufficient alkylcarboxyalkylthiocarbonate salt is used together with the polycarboxylic acid derivative so as to impart to the slurry a weight ratio of first depressant composition to second depressant composition in the range of from about 20:80 to about 80:20.

14. A process as in claim 13 wherein the polycarboxylic acid derivative and the alkylcarboxyalkylthiocarbonate salt each contain fewer than about 10 carbon atoms and are used together in the slurry in a combined amount on a weight basis in the range from about 0.01 to about 20 lbs per ton of solids in the slurry.

15. A process as in claim 13 wherein the polycarboxylic acid derivative and the alkylcarboxyalkylthiocarbonate salt each contain fewer than about 10 carbon atoms and are used together at a combined concentration in the slurry in the range of from about 0.1 to about 10 lbs per ton of solids in the slurry.

16. In a process for the recovery of copper values from an ore or concentrate, wherein the values are recovered in a froth from an aqueous slurry of solids of the ore or concentrate of the ore, the improvement comprising employing a blend of a first depressant and a second depressant in the slurry to depress at least one of iron or nickel from the froth, wherein the first depressant is represented by the formula

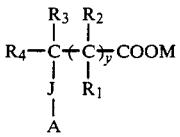

where M represents ammonium or Group IA metal; J represents S or NH; $R_1$ and $R_2$ are selected from the group consisting of hydrogen and alkyl group having 1–3 carbon atoms; $R_3$ and $R_4$ are selected from the group consisting of hydrogen, alkyl groups having 1–3 carbon atoms and —COOM where M is as previously defined; A represents

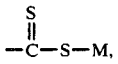

where M is as previously defined or H or M as previously defined provided that J represents S; and y is 0–7; and wherein the second depressant is prepared by the reaction between a material represented by the formula

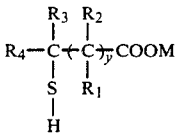

with a material represented by the formula

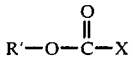

where M, y, $R_1$, $R_2$, $R_3$ and $R_4$ are as previously defined, R′ is an alkyl group having 1–3 carbon atoms and X is selected from the group consisting of Cl, Br and I.

17. A process as in claim 16 wherein the first depressant and the second depressant each contain fewer than about 10 carbon atoms and together form a blend, wherein M represents sodium, wherein X represents chlorine, and wherein the first depressant composition comprises a derivative of a mercaptodicarboxylic acid.

18. A process as in claim 17 wherein the blend contains the first depressant and the second depressant at a weight ratio in the range of from about 20:80 to about 80:20 and the blend is employed in an amount in the range of from about 0.1 to about 10 lbs of minerals depressant per ton of solids.

19. A process for producing a composition useful as a minerals depressant comprising reacting a haloformic ester having the formula

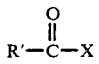

wherein R′ represents an alkyl group having 1–3 carbon atoms and X is selected from the group consisting of chlorine, bromine, and iodine, with material represented by the formula

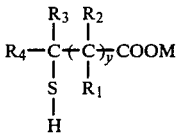

wherein M represents ammonium or Group IA metal, $R_1$ and $R_2$ are selected from the group consisting of hydrogen and alkyl group having 1–3 carbon atoms; $R_3$ and $R_4$ are selected from the group consisting of hydrogen, alkyl group leaving 1–3 carbon atoms and —COOM wherein M is as previously defined, and y is 0–7.

20. A process as in claim 19 wherein X represents chlorine and wherein M represents sodium.

* * * * *